US005108106A

United States Patent [19]

Cook

[11] Patent Number: 5,108,106

[45] Date of Patent: Apr. 28, 1992

[54] GOLF ALIGNMENT TEMPLATE

[76] Inventor: Ross M. Cook, 2297 N. 800 East, Logan, Utah 84321

[21] Appl. No.: 434,326

[22] Filed: Nov. 13, 1989

[51] Int. Cl.[5] ..... A63B 69/36

[52] U.S. Cl. ..... 273/187 R; 273/186 R

[58] Field of Search ..... 273/187 R, 187 A, 183 A, 273/183 B, 186 R, 186 B, 186 C, 191 R, 192

[56] References Cited

U.S. PATENT DOCUMENTS

| | | | |
|---|---|---|---|
| 2,150,580 | 3/1939 | Crowley | 273/187 R |
| 2,169,407 | 8/1939 | Crowley | 273/187 R |
| 2,457,351 | 12/1948 | Crowley | 273/187 R |
| 2,941,808 | 6/1960 | Smith et al. | 273/187 R |
| 3,561,764 | 2/1971 | Thomas | 273/183 A |
| 3,658,344 | 4/1972 | Kimble | 273/187 R |
| 3,860,247 | 1/1975 | Taylor | 273/186 C |
| 4,101,130 | 7/1978 | Richards | 273/187 A |
| 4,322,084 | 3/1982 | Reece et al. | 273/187 R |
| 4,434,983 | 3/1984 | Taggart | 273/187 R |
| 4,538,815 | 9/1985 | Poirier | 273/187 R |
| 4,544,161 | 10/1985 | Guendling, Jr. | 273/187 A |
| 4,647,048 | 3/1987 | Welch | 273/187 R |
| 4,718,674 | 1/1988 | Henry | 273/187 R |
| 4,736,952 | 4/1988 | Taft et al. | 273/187 R |
| 4,784,393 | 11/1988 | Williams et al. | 273/187 R |

*Primary Examiner*—George J. Marlo
*Attorney, Agent, or Firm*—Workman, Nydegger & Jensen

[57] ABSTRACT

A golf aid device is disclosed. The golf aid device essentially constitutes a template having a general oval shaped body defining an upper portion and a lower portion. The body further includes a rearwardly projecting arm and a front foot guide attached to the front of the body, with a rear foot guide slidably attached to said rearwardly projecting arm. The upper portion of the body defines a golf swing line. The lower portion of the body defines a golf stance line. Also attached to the body is a golf ball positioning arm rotatably and slidably attached to the lower portion of the body. The device also includes markings on the lower portion and the upper portion such that the ball positioning arm can be properly aligned for predetermined golf shots. According to the manner in which the golf ball positioning arm is set with respect to the markings on the body, the ball can be placed for a straight shot, a hook shot, or a slice shot. Thus, the device is capable of aiding in positioning the golfer's feet, designating the stance line, designating the swing line and target line, aligning the club face, and indicating the proper position for placement of the ball for the desired type of shot.

3 Claims, 4 Drawing Sheets 17
26
24
RF
16
12
SWING LINE
STANCE LINE
18
H S H S H S

GOLF ALIGNMENT TEMPLATE

BACKGROUND

1. The Field of the Invention.

The invention is related to a device for aiding in training golfer's in the positioning of the golf ball and in obtaining a proper stance. More particularly, the present invention is related to a device which can aid the golfer in obtaining a proper stance, swinging a golf club in a proper direction, and in positioning the golf ball in order to intentionally hit a straight shot, hook shot, or slice shot.

2. Technical Background.

The game of golf is rapidly growing in popularity, both in the United States and elsewhere around the world. As a result of the rapid growth in the number of individuals playing the game of golf, there is a corresponding increase in the number of relatively inexperienced players. These players are constantly struggling with their games. Indeed, beginners may find that the game is frustrating and not enjoyable.

At the same time more experienced players are becoming more and more interested in improving their games. As a player increases in experience and technique, it often becomes desirable for the player to learn to hit shots other than simple straight shots. Such shots are often referred to as hook or draw shots in the event the ball travels in an arc in the general direction of the swing. When the ball travels in an arc away from the direction of the swing the shot is referred to as a slice or fade shot.

There are a number of factors involved in hitting any golf shot, whether the shot be straight, or a hook or slice. One factor is the stance, or the position of the golfer's feet with respect to the ball. In order to obtain a desirable shot, the stance or foot position of the golfer must be proper.

It is similarly important that the swing of the golf club be in the correct direction. This is sometimes referred to as the swing line. In order to hit any golf shot in the correct direction it is necessary that the swing line (or the path of club travel) be proper.

It is also important that the golf ball be positioned at the proper position with respect to the golfer and the correct distance from the golfer. In addition, the golf ball must be positioned correctly in the forward and backward directions (longitudinal axis) with respect to the golfer. For example, if the golfer desires to hit a hook shot, the ball should be positioned slightly forward from the position for a straight shot. Similarly, if the golfer desires to hit a slice shot, the ball should be positioned slightly in back of the ball position for a straight shot.

The numerous factors that must be considered in placing and hitting the ball can be overwhelming to the beginner, and can be the source of frustration to the experienced player. Misjudging any of the factors described above will result in a less than optimal shot.

In order to improve on one's golf game, many people engage golf professionals as instructors. Such instruction is useful in developing good form and a solid, competitive game. However, golf instruction is expensive and time consuming. Accordingly, most people limit the amount of time actually spent with a golf professional. Even if lessons are taken the individual golfer will spend most of his golfing time playing or practicing the game outside of the supervision of the golf professional. During these times it may be difficult to maintain good form and to avoid destructive habits.

In order to facilitate development of a person's golf game various devices have been developed in order to aid in practicing, without developing problems with a person's golf stroke. A number of these devices include means for positioning the golfer's feet such that a proper stance is maintained. These devices may take the form of a mat that lies on the ground or they may be constructed of a series of elongated rods that are adjusted in order to indicate the proper foot position for the golfer.

While some of these devices also provide some indication as to the recommended location of the ball, they generally do not aid in directing the golfer's swing. Most such devices do not indicate a swing line, as well as a proper stance.

Some well known practice mats combine the ability to indicate the appropriate stance with some type of indication of the proper path of the golf club. However, most of these mats are specifically designed to constitute permanent or semi-permanent fixtures at a practice range or putting green. Most of these mats are not mobile and, thus, do not provide any aid to the golfer who seeks to practice on the actual golf course.

As the golfer's game improves and increases in sophistication, the golfer often desires the ability to hit the golf ball over a curved path, as well as in a straight line. This allows the golfer the ability to hit around obstacles such as sand traps, trees, and water hazards. It also provides the golfer the ability to hit the ball down curved (dogleg) fairways This skill requires that the golfer be able to adjust his stance, swing line, and the position of the ball with respect to the stance and swing lines. Very few novice golfers have the ability to make such shots on command. Furthermore, known golf aid devices fail to provide significant help in making such a shot.

Accordingly, it would be a major advancement in the art to provide a golf aid device that was mobile and could be used by the golfer both on the practice range and on the actual golf course. It would also be an advancement in the art if a single golf aid device provided means for adjusting a number of be an advancement in the art to provide a golf aid device that provided means for determining an appropriate stance, was well as the proper club swing line.

It would be a further advancement in the art if the same device could aid the golfer in the placement of the ball with respect to the golfer's swing and stance. It would also be a major advancement in the art if such a device were provided that would allow the golfer to align a hook or slice shot, as well as a straight shot.

Such methods and apparatus are disclosed and claimed herein.

BRIEF SUMMARY AND OBJECTS OF THE INVENTION

The present invention is related to a device for aiding in aligning golf shots. The present invention, however, also aids the golfer in establishing a correct stance, aligning the club face, and in positioning the golf ball such that various types of shots can be achieved. These shots include, for example, straight shots, hook shots, and slice shots. All of these tasks are accomplished using a device which is light, portable, and can be folded in order to transport the device in a golf bag or other similar container.

The present invention is essentially a template that is placed on the ground by the golfer. The template establishes a longitudinal axis which runs generally in the direction in which the ball is to be hit. The template may be comprised of several distinct parts. The primary parts are a body portion and an attached ball positioning arm.

The body of the template is, in one preferred embodiment, generally oval in shape, having a rearwardly projecting arm. The upper portion of the oval section of the body generally designates the swing line or the general direction of club travel through the ball. Accordingly, the golfer is provided with a simple, yet effective, means of determining the direction of the club stroke.

The lower portion of the oval section of the body generally designates the stance line. This line indicates in a general manner the proper location of the golfer's feet and body with respect to the ball.

The golfer is further aided in obtaining a proper stance by at least one foot guide formed as part of, or attached to, the body. In one preferred embodiment of the device, the front foot guide is molded integrally with the body. It will be appreciated, however, that the foot guide could alternatively form a separate piece attached to the body. This provides the golfer with the proper positioning of the front foot with regard to the swing line and the position of the ball.

The device may preferably include a second rear foot guide. This foot guide may be slidably attached to the rearwardly extending arm described above. Thus, the golfer is able to position the rear foot guide in a manner that suits his particular stance and the type of club used for the shot, without disturbing the other aspects of his golf shot.

The oval portion of the body also includes a series of markings. In the embodiment illustrated herein, those markings include the letters "S" and "H." However, it will be appreciated that any other form of marking or designation would also be suitable. The designations S and H refer to "slice" and hook." The body includes a series of these designations alternating on both the upper and lower portions of the body. The two forwardmost sets of letters S and H are used for lining up shots with woods. There are two sets of letters in order to allow the golfer to align both long and short woods. The next set of designations is used for lining up long iron shots. The next set of designations is for lining up middle iron shots, and the final set of designations is for lining up short iron shots.

In order to establish the correct stance and swing with respect to the location of the ball, the ball positioning arm is employed. As was mentioned above, the ball positioning arm is slidably and rotatably mounted on the oval portion of the body. When lining up a shot, the ball positioning arm slides to the portion of the body corresponding to the type of club positioning arm slides to the front of the oval. If a short iron is used, the ball positioning arm slides to the rear of the oval.

Once the ball positioning arm is located in the appropriate section of the body, the type of shot is chosen. For a straight shot, the arm is aligned in a generally perpendicular manner with the longitudinal axis. In order to achieve this position the golfer may wish to align the arm between the markings H and S on the upper portion, and between the S and H on the lower portion. If a hook is desired, the arm is aligned with the H marking on the upper portion and the H on the lower portion. Thus, the distal end of the arm is pointing slightly forward. If a slice is desired the arm is aligned with the S on the upper portion and the S on the lower portion Thus, the distal end of the arm is pointing slightly toward the rear. When the ball is placed off the end of the distal end of the arm, the desired type of shot is lined up.

Also connected to the distal portion of the ball positioning arm is a the target line arm. This arm is generally perpendicular to the ball positioning arm and indicates the general direction of the golfer's target, such as for example, the hole.

In order to position the golf club face, the ball positioning arm is used. The face of the club is held such that it is generally parallel to the line defined by the ball positioning arm. This assures that the club contacts the ball properly to achieve the desired shot.

It can be seen, therefore, that when the device is set up for a shot, the golfer is provided with all the information necessary to make the desired shot. The foot guides and the stance line of the lower portion of the body provide sufficient information to allow the golfer to established a desired stance The ball positioning arm, when properly aligned using the markings on the upper and lower portions of the body, allow stance, ball face position, and ball position to be adjusted such that a chosen shot can be made. At the same time, an estimate swing line is established by the upper portion of the body, and the target is identified by the target line arm.

An additional advantage of the invention is that it is easily folded. The ball positioning arm and the target line arm are rotatably attached to one and another and the ball positioning arm is rotatably attached to the body. Thus, when the golfer has hit his shot and desires to move on, the device is easily carried or placed in a conventional golf bag.

The template may also be constructed of light, yet durable materials. Various types of plastics are likely to be preferred. It will be appreciated, however, that a wide range of materials could be used. Such materials could include wood, metals, paper and even some types of fabric.

Accordingly, it is a primary object of the present invention to provide a golf aid device that is mobile and can actual golf course.

It is a further object of the present invention to provide a single golf aid device which provides means for adjusting a number of different variables in a golf shot, such as appropriate stance, proper positioning of the club face, and proper club swing line.

It is another object of the present invention to provide a device which can aid the golfer in the placement of the ball with respect to both the golfer's swing and stance.

It is also a major object of the present invention to provide such a device which allows the golfer to align a hook or slice shot, as well as a straight shot.

These and other objects of the present invention will become apparent from the following detailed description of the invention, the attached drawings, and the appended claims.

DETAILED DESCRIPTION OF THE PREFERRED EMBODIMENTS

The present invention can be more fully understood with reference to the drawings wherein like parts are designated with like numerals throughout. As discussed above, the present invention is related to a golf alignment device which serves a plurality of useful functions in aligning golf shots. The device, sometimes also referred to as a template, is illustrated in FIG. 1 and generally designated 10.

Figure 1:
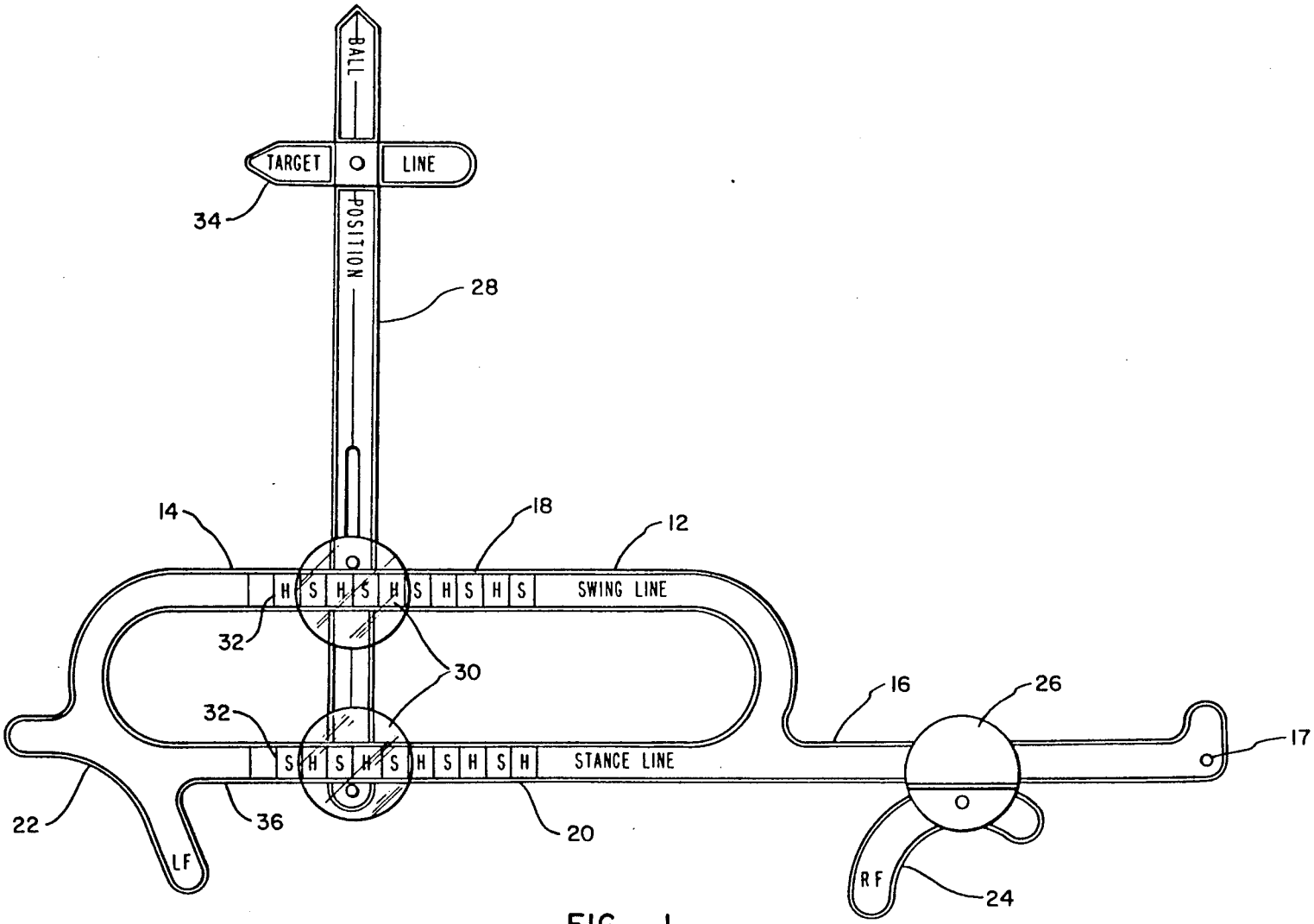
FIG. 1 is a top plan view of the present invention in position to line up a straight shot.

FIG. 1 illustrates the general configuration of one preferred embodiment of the present invention. The central structural feature of the device is the body 12. The body 12 comprises a generally oval shaped portion 14 and a rearwardly projecting arm 16. For ease of description, the oval can be divided into an upper portion 18 and a lower portion 20. Both the upper portion 18 and the lower portion 20 define a longitudinal axis which extend in the general direction of the target at which the golf ball is directed. As will be discussed in further detail below, this longitudinal axis serves several functions in lining up the golf shot and allowing the golfer to correctly position himself.

Forming the forwardmost structure of the device 10 is a foot placement means. As illustrated in FIG. 1, that foot placement means comprises a foot guide 22. In the illustrated embodiment, the foot guide 22 is molded integrally with the body 12. However, it will be appreciated that the foot guide 22 could be attached to the body as a separate piece if desired.

The foot guide 22 provides means for directing the golfer in the correct placement of his feet with respect to the device and, ultimately, with respect to the ball. The golfer simply places his forward foot near the foot guide 22.

Similarly, a rear foot guide may also be included within the device. As illustrated in FIG. 1, the rear foot guide 24 is slidably mounted to the rearwardly projecting arm 16. Foot guide 24 is attached to the device in any conventional desirable manner. As shown in FIG. 1, the rear foot guide is attached using a slidable mounting bracket 26 and is attached to the rearwardly projecting arm 16.

One additional feature of the rearwardly projecting arm 16 is the hole 17 in the arm. The hole 17 can be used in storing the device. For example, the hole 17 can be configured such that it can receive a hook or nail, allowing the device to hung up when not in use.

When in use, the rear foot guide 24 is used in much the same way as is the forward foot guide 22. The rear foot guide 24 is slid into place along the rearwardly projecting arm 16. When a comfortable location is obtained, the golfer simply places his front foot in approximate contact with the forward foot guide 22 and his rear foot in approximate contact with the rear foot guide 24. This allows the golfer to easily achieve a proper stance prior to swinging at the golf ball. Foot guide 24 is slidable along the rearwardly projecting arm 16 in order to allow the golfer to adjust his stance for different shots. For example, a wider stance is preferred for woods than is preferred for irons.

The lower portion 20 of the oval 14 section of the body 12 also provides information concerning the golfer's stance. The lower portion defines a stance line which is approximately parallel to the longitudinal axis of the device as a whole. The golfer, therefore, can check his stance by placing his feet next to the foot guides and then further checking his stance to makes sure that it conforms to the stance line.

The upper portion 18 of the oval 14 is also useful in defining a proper shot. The upper portion 18 can be used to define the approximate swing line, or club path, through the ball. This provides the golfer with immediate input in lining up the swing of the golf club in such a manner as to assure a smooth and effective swing.

Another important feature of the device 10 in the embodiment illustrated is the ball positioning arm 28. The ball positioning arm 28 is slidably mounted near its proximal end by means of another slidable mounting bracket 30. The slidable mounting bracket 30 is attached to the lower portion 20 of the oval 14. A second slidable mounting bracket 30 may also attach the arm 28 to the upper position 18 as illustrated. It will be appreciated, however, that the arm could be mounted in any one of a number of different ways, and could indeed be attached to a different part of the device. Accordingly, it will be appreciated that the means and location of attachment of the arm are not essential features of the invention.

Also illustrated in FIG. 1 are a series of markings 32 on the upper portion 18 and the lower portion 20. The markings on the upper portion 18 begin at the front of the oval (left for right handed golfers and right for left handed golfers) with the letter H and then alternate with the letter S four times along the upper portion 18. Similarly, markings on the lower portion 20 begin at the left with the letter S and then alternate with the letter H four times along the lower portion 20.

It will likely be desirable to color code the markings. For example, the two forwardmost H and S on both the upper and lower portions may be colored red to indicate the markings for woods. The next set to the right may be colored yellow, the next could be colored brown, and the set furthest to the right could be colored blue.

In order to line up a shot using the present invention, the template 10 is placed on the ground near the golf ball. The golfer first decides the type of club that is needed for the shot. For the purposes of this discussion, there are four general categories of clubs, including: woods, long irons, middle irons, and short irons. The golfer next determines what type of shot is desired. The types of shots available, for purposes of this discussion, include straight shots, hook or draw shots, and slice or fade shots.

Once these decisions are made it is possible to properly align the ball positioning arm 28. If the shot is, for example, a straight long iron shot, the ball positioning arm is moved over the set of markings second from the left, i.e. the set of markings for long irons. Since the shot is straight, the arm 28 is placed in the middle of the H and S on both the upper and lower portions.

In order to complete the process of lining up the ball the target line arm 34 is used. The target line arm 34 is preferably somewhat smaller than the ball positioning arm 28, and is rotatably mounted near the distal end of the positioning arm 28. The target line arm 34, however, is capable of snapping engagement into the positioning arm 28 such that it defines an essentially perpendicular angle with the positioning arm.

In order to complete the alignment of the shot, the target line arm 34 is simply pointed in the direction of the target. This, along with the other orientation steps described above, results in proper alignment of the device for the desired shot.

Once the template is aligned, the line defined by the ball positioning arm 28 is used to align the club face. As mentioned above, the club face will usually be aligned such that it corresponds to the line defined by arm 28.

Figure 2:
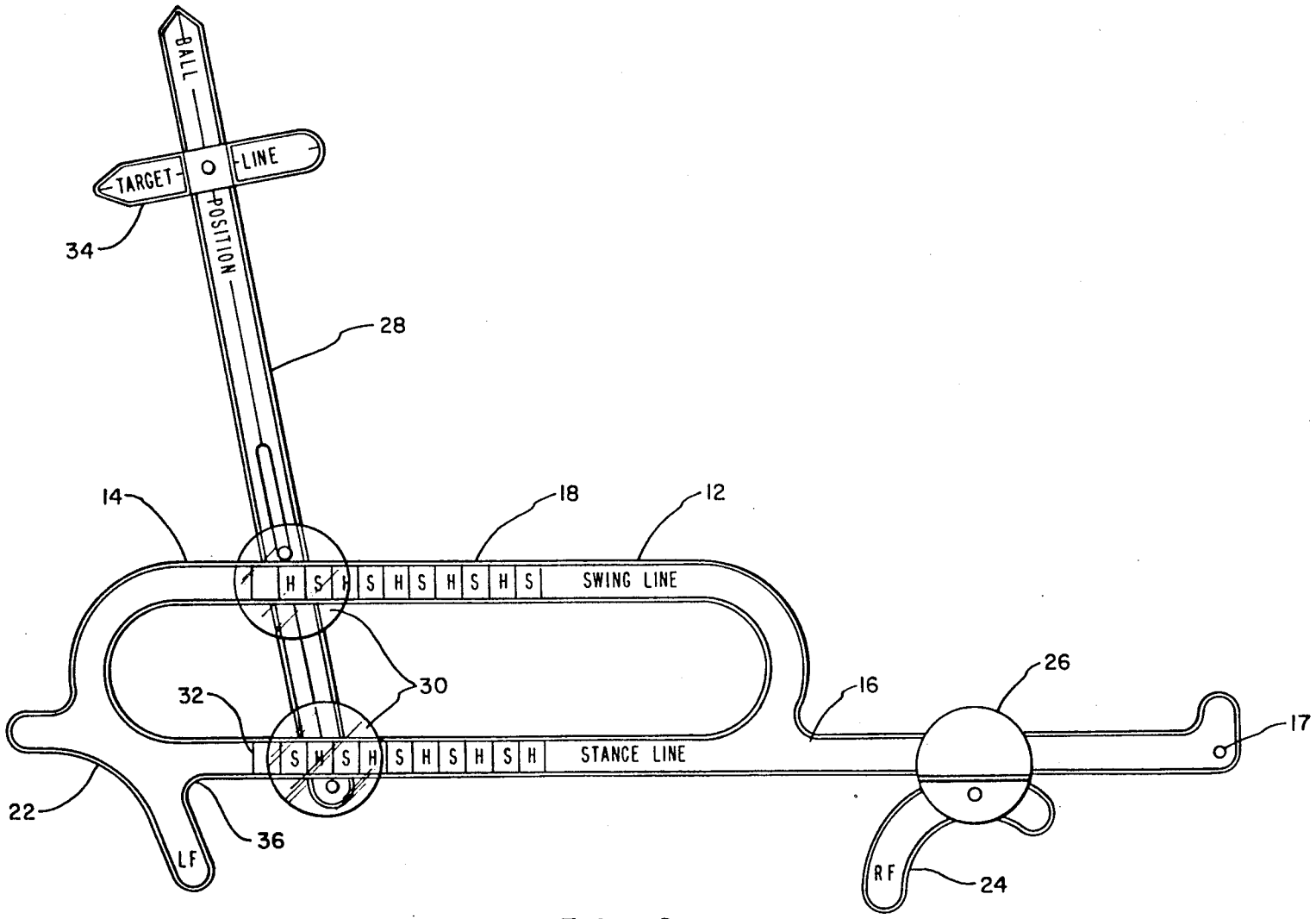
FIG. 2 is a top plan view of the present invention in position to line up a hook shot.

FIG. 2 illustrates the template 10 of FIG. 1 aligned for a hook shot with a wood club. The positioning arm 28 is aligned with the forwardmost set of letters, which letters are used in lining up shots for long clubs, particularly woods. It will also be appreciated that the arm 28 is over the forwardmost H's. This shows the ball position for a hook shot. The ball is placed at the end of the distal end of the positioning arm.

Figure 3:
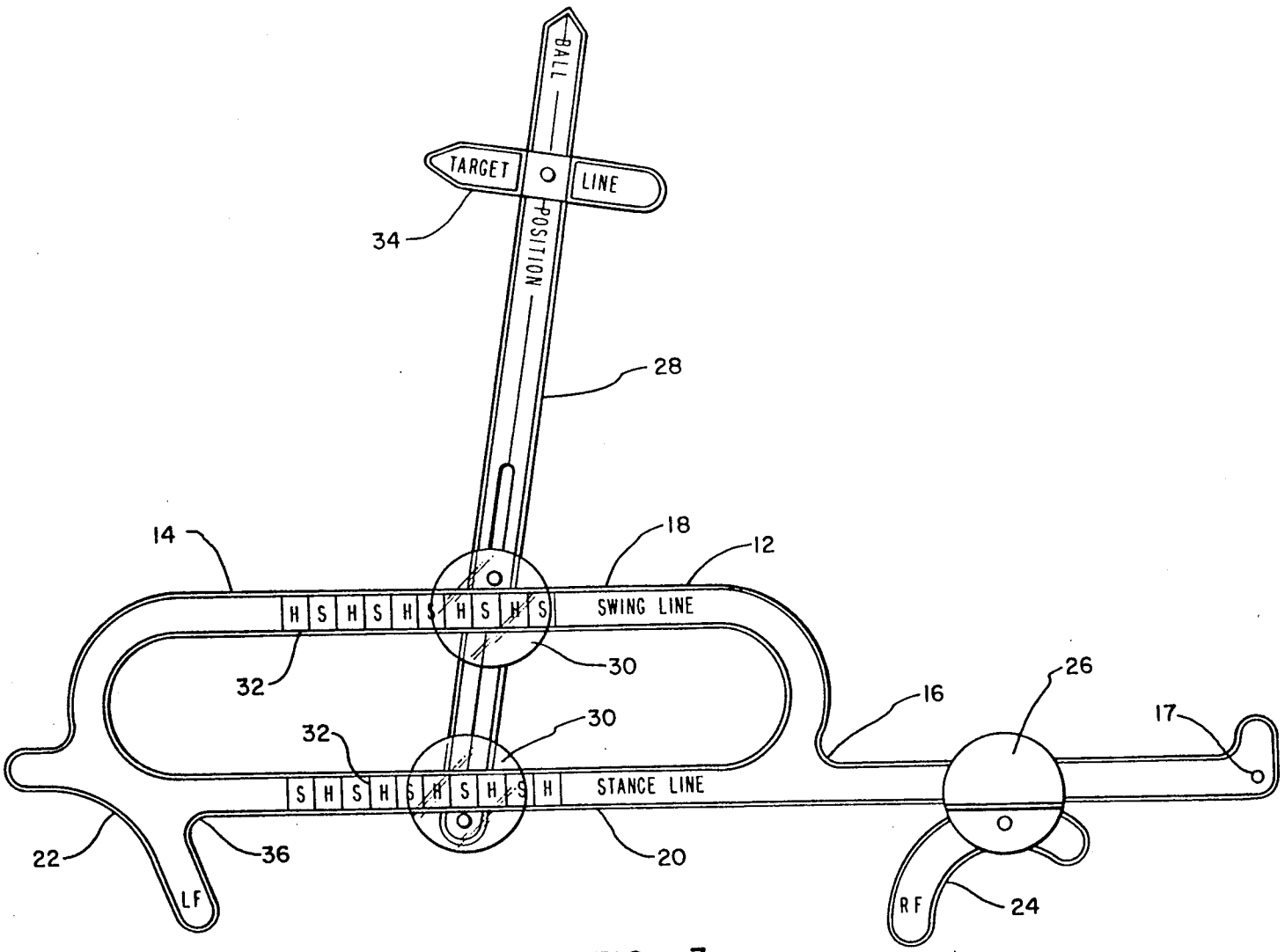
FIG. 3 is a top plan view of the present invention in position to line up a slice shot.

FIG. 3 illustrates the template of FIG. 1 aligned for a slice shot with a short iron. The positioning arm 28 is aligned with the rear most set of letters, which letters are used to line up short iron shots. The arm 28 is positioned over the rearmost set of S's indicating the position for a slice shot.

Figure 4:
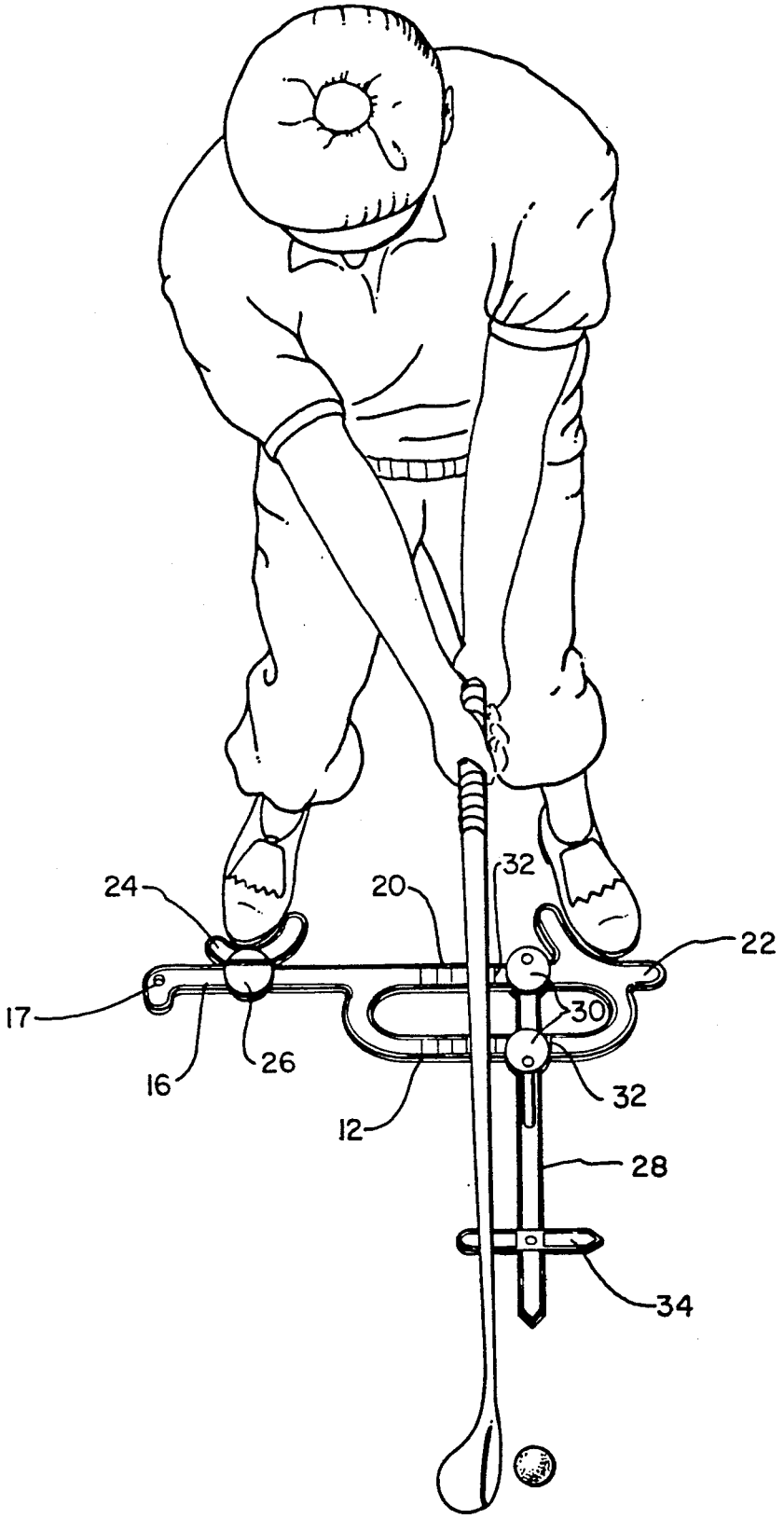
FIG. 4 is a top perspective view showing a golfer lining up a shot using the present invention.

FIG. 4 illustrates the template 10 in use by a golfer. It can be seen that the golfer has established a proper stance by adjusting the rear foot guide 24 to the location desired, and then placing his feet in contact with the foot guides. His stance is further aligned by using the line established by the lower portion as the stance line and club face alignment.

The position of the golfer with respect to the ball is also easily determined. The type of club and shot are selected. The ball positioning arm 28 is then adjusted as described above. The ball should be placed in the line of the positioning arm 28 and off the distal end of the arm 28. The target arm 34 has already been directed in the direction of the target. Thus, all the golfer must do is swing the club along the swing line established by the lower portion 20.

It will be appreciated that the template 10 is foldable such that is can easily be transported, for example inside the golfer's golf bag. The target line arm 34 can be rotated such that it corresponds to the ball positioning arm 28. The ball positioning arm can then be rotated around the slidable mounting bracket 30 such that it corresponds to the lower portion 20 and/or the rearwardly projecting arm 16.

A final structural feature of interest comprises the ridge 36 that is formed around each of the structural parts. The ridge provides additional structural integrity to the device. It also provides an effective track for the movement of the slidable parts. Thus, the device is found to function more smoothly.

In summary, the present invention accomplishes each of the objects of the invention. The present invention provides a golf aid device that is mobile and can be used by the golfer both on the practice range and on the actual golf course. It also provides a single golf aid device having means for adjusting a number of different variables in the golf shot such as determining an appropriate stance, was well as the proper club swing line.

The present invention also provides a template which aids the golfer in the placement of the ball with respect to the golfer's swing and stance. The present invention also allows the golfer to align a hook or slice shot, as well as a straight shot.

It will be appreciated that the present invention is capable of being incorporated into the form of a variety of embodiments, only a few of which have been illustrated and described herein. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A golf aid comprising a template defining an elongated swing line indicating upper portion and an elongated stance line indicating lower portion substantially parallel thereto, a front foot guide attached to the front of said lower portion, a rear foot guide attached to the rear of said lower portion, an elongated golf ball and club face positioning arm rotatably and slidably attached to said lower portion, a target line indicating arm pivotally mounted to said golf ball and club face positioning arm adjacent the end thereof remote from said lower portion, and markings on said lower portion and said upper portion for jointly indicating the required angular orientation of said golf ball and club face positioning arm relative said lower portion to indicate the desired location of a golf ball at the remote end of said golf ball and club face positioning arm for hitting straight, hook and slice shots when the club's ball striking face is aligned generally along the line defined by said ball positioning arm, and said template being dimensioned to be positionable between the golfer and the golf ball in order to minimize the possibility of interfering with the swing of the golfer and to be portable for use during a game of golf.

2. A golf aid as defined in claim 1 wherein the forward and rearward ends of said upper and lower portions are joined to define the appearance of an oval shaped body.

3. A golf aid as defined in claim 1 wherein said elongated lower portion includes a rearwardly projecting extension, and said rear foot guide is slidably attached thereto.

* * * * *

UNITED STATES PATENT AND TRADEMARK OFFICE

CERTIFICATE OF CORRECTION

PATENT NO. : 5,108,106

DATED : April 28, 1992

INVENTOR(S) : ROSS M. COOK

It is certified that error appears in the above-identified patent and that said Letters Patent is hereby corrected as shown below:

Column 2, line 31, after "fairways" insert --.--
Column 2, line 43, after "of" insert --different variables in the golf shot. For example, it would--
Column 2, line 45, "was well" should be --as well--
Column 3, line 57, after "club" insert --used. For example, if a wood is being used, the ball--
Column 4, line 4, after "portion" insert --.--
Column 4, line 9, delete "the"
Column 4, line 23, "established" should be --establish--
Column 4, line 23, after "stance" insert --.--
Column 4, line 32, delete first occurrence of "and"
Column 4, line 45, after "can" insert --be used by the golfer both on the practice range and on the--
Column 5, line 53, "hung up" should be --be hung up--
Column 6, lines 5-6, "to makes sure" should be --to make sure--
Column 7, line 20, "rear most" should be --rearmost--
Column 8, line 4, "was well" should be --as well--

Signed and Sealed this

Fourteenth Day of September, 1993

Bruce Lehman

*Attest:*

BRUCE LEHMAN

*Attesting Officer*

*Commissioner of Patents and Trademarks*